US012312146B2

(12) United States Patent
Albino

(10) Patent No.: US 12,312,146 B2
(45) Date of Patent: May 27, 2025

(54) ONE-WAY VALVE FOR FOOD PACKAGES

(71) Applicant: Micvac AB, Mölndal (SE)

(72) Inventor: Robert Albino, Gothenburg (SE)

(73) Assignee: Micvac AB, Mölndal (SE)

( * ) Notice: Subject to any disclaimer, the term of this patent is extended or adjusted under 35 U.S.C. 154(b) by 0 days.

(21) Appl. No.: 18/728,140

(22) PCT Filed: Jan. 13, 2023

(86) PCT No.: PCT/EP2023/050719
§ 371 (c)(1),
(2) Date: Jul. 11, 2024

(87) PCT Pub. No.: WO2023/138991
PCT Pub. Date: Jul. 27, 2023

(65) Prior Publication Data

US 2024/0417152 A1 Dec. 19, 2024

(30) Foreign Application Priority Data

Jan. 19, 2022 (EP) ..... 22152133

(51) Int. Cl.
*B65D 77/22* (2006.01)
*B65D 81/34* (2006.01)

(52) U.S. Cl.
CPC ..... *B65D 77/225* (2013.01); *B65D 81/3453* (2013.01)

(58) Field of Classification Search
CPC ..... B65D 2205/05; B65D 81/3453; B65D 81/34; B65D 81/3446; B65D 81/77225
USPC ..... 137/72; 220/203.29
See application file for complete search history.

(56) References Cited

U.S. PATENT DOCUMENTS 2,946,502 A 7/1960 Metzger
2013/0048125 A1 2/2013 Hoffman et al.

FOREIGN PATENT DOCUMENTS

KR 10-2221409 B1 2/2021
WO WO-2004106190 A1 * 12/2004 ..... B65D 77/225

OTHER PUBLICATIONS

Communication about intention to grant a European patent Mailed on Mar. 20, 2024 for EP Application No. 22152133, 6 page(s).
(Continued)

*Primary Examiner* — Anthony D Stashick
*Assistant Examiner* — Lauren Kmet
(74) *Attorney, Agent, or Firm* — Alston & Bird LLP

(57) ABSTRACT

A one-way valve for mounting over an aperture formed on a food package for cooking, storing and/or heating of ready-to-eat food is disclosed. The one-way valve comprises a first membrane comprising a top surface and a bottom surface, where the bottom surface is adapted to be fixed to the food package. The one-way valve further comprises a second membrane comprising an upper surface and a lower surface. The lower surface of the second membrane is adhered to the top surface of the first membrane by means of a first adhesive and a second adhesive. The first adhesive is arranged on a center portion and each of two lateral edge portions of an overlapping surface area of the first membrane and second membrane.

14 Claims, 6 Drawing Sheets

(56) References Cited

OTHER PUBLICATIONS

Extended European Search Report Mailed on Jul. 19, 2022 for EP Application No. 22152133, 5 page(s).
IPEA/408—Written Opinion of the IPEA Mailed on May 4, 2023 for WO Application No. PCT/EP23/050719, 4 page(s).
Outgoing—ISA/210—International Search Report Mailed on May 4, 2023 for WO Application No. PCT/EP23/050719, 3 page(s).

* cited by examiner

ONE-WAY VALVE FOR FOOD PACKAGES

CROSS REFERENCE TO RELATED APPLICATIONS

This application is a National Stage Application, filed under 35 U.S.C. § 371, of International Application No. PCT/EP2023/050719, filed Jan. 13, 2023, which claims priority to European Application No. 22152133.9, filed Jan. 19, 2022; the contents of both of which are hereby incorporated by reference in their entirety.

BACKGROUND

Related Field

The present invention relates to a one-way valve, in particular the present invention relates to a one-way valve designed to be mounted on a food package and arranged to open in response to a pressure inside the package exceeding a threshold pressure and a temperature inside the package exceeding a threshold temperature. The present invention also relates to a food package comprising such a one-way valve and a method for manufacturing such a one-way valve.

Description of Related Art

A growing trend in the world is the consumption of so called ready-to-eat food, i.e. food which does not need cooking or has already been cooked. Such meals are either frozen or refrigerated in order to have a reasonable long shelf life. Generally, one can say that frozen food has the drawback of being less tasty and looking less appetizing with impressive shelf life, while refrigerated food generally appears more appetizing it comes at the cost of considerably shorter shelf life. In order to prolong the shelf life for such refrigerated ready-to-eat food pasteurisation is often used. Conventionally, the process of pasteurisation is combined with a removal of oxygen from the interior of the package in order to minimise bacterial growth. Such removal of oxygen may be either of creating a slight under-pressure in the food package or the replacement of the oxygen by injection of some other suitable gas into the food package.

In a cooking and pasteurisation method used by the applicant the food is placed in a food package comprising a plastic tray having a plastic cover in the form of a see-through thin film which is sealed along the tray edges to create an interior which is completely sealed off from the surroundings. Further, a valve may be provided in this plastic film which may be automatically opened when an overpressure occurs within the package. Such overpressures are e.g. created when the package is positioned in a microwave oven and the food is cooked by exposing it to electromagnetic radiation. It may also be created through convection in e.g. furnaces with air heating and steam, or by exposing the package to thermal radiation, e.g. through infra-red radiation. When the food is cooked, a large amount of steam is created. The steam is building up an overpressure such that the valve is opening and letting both oxygen and steam out. When the food has been cooked the microwave oven is shut off, whereby the steam production instantaneously stops. The valve is then designed to close almost immediately due to the reduction of internal overpressure and the lowering of the ambient temperatures. The food packages are cooled to a suitable storing temperature and may be delivered to retailers for later use. An important aspect is that these types of valves differ from other valves used in the food industry, such as e.g. those used in connection with packages for coffee or the like. In more detail, these valves open at much higher relative overpressures, in the range of 100 hPa, as compared to those used in connection with packages for coffee, which open at relative overpressures in the range of 10 hPa. The term relative overpressure is here to be construed as how much the pressure inside the package exceeds the pressure outside of the food package, i.e. the difference between the internal and the external pressure. This consequently results in different requirements for the different types of valves.

The closure of the valve after cooking is important in order to seal the interior of the package and food from ambient air and contaminating substances. The valve must hence be designed such that it is certain that it is not affected by e.g. food residuals or moisture that may be blown into the valve during cooking. Such valves are per se known, and for example disclosed in EP 1 383 693 B1.

However, a problem with many of the one-way valves for food packages that are known today is that the associated manufacturing processes are relatively complex with a multitude of process steps and parameters that need to be continuously adjusted in order to reduce waste.

Accordingly, there is always a need for improvements in the art, particularly there is always a need for one-way valves for food packages that are more cost effective, easier to manufacture, and results in less waste during the manufacturing process. Stated differently, there is still a need for a one-way valve for food packages that results in a higher yield in manufacturing as compared to previously known valves.

SUMMARY

It is therefore an object of the present invention to provide a one-way valve, a food package, and a method for manufacturing a one-way valve, which alleviate all or at least some of the drawbacks of presently known solutions.

This object is achieved by means of a one-way valve, a food package, and a method for manufacturing a one-way valve as defined in the appended independent claims. The term exemplary is in the present context to be understood as serving as an instance, example or illustration.

According to a first aspect of the present invention, there is provided one-way valve for mounting over an aperture formed on a food package for cooking, storing and/or heating of ready-to-eat food. The one-way valve comprises a first membrane comprising a top surface and a bottom surface, where the bottom surface is adapted to be fixed to the food package. The one-way valve further comprises a second membrane comprising an upper surface and a lower surface. The lower surface of the second membrane is adhered to the top surface of the first membrane by means of a first adhesive and a second adhesive. The first adhesive is arranged on a center portion and each of two lateral edge portions of an overlapping surface area of the first membrane and second membrane. The center portion and the two lateral edge portions are non-overlapping, and the lateral edge portions extend from a first longitudinal edge to an opposite second longitudinal edge of the overlapping surface area. The second adhesive is arranged on each of two intermediate portions between each lateral edge portion and the center portion. The two intermediate portions extend from the first longitudinal edge to the opposite second longitudinal edge of the overlapping surface area. Moreover, a bond strength of the second adhesive is stronger than that of the first adhesive. The first membrane further comprises an opening such that a canal is formed between the first membrane and the second membrane when the one-way valve is mounted over the aperture of the food package and a gas pressure inside the food package exceeds a threshold value. The canal extends from the opening to at least one of the first longitudinal edge and the second longitudinal edge via the center portion of the overlapping surface area.

According to a second aspect of the present invention, there is provided a food package for cooking, storing and/or heating of ready-to-eat food. The food package comprises a food container and a plastic film for sealing the food container from ambient. Moreover, the plastic film includes an aperture. The food package further comprises a one-way valve according to any one of the embodiments disclosed herein, the one-way valve covers the aperture such that the opening of the one-way valve overlaps the aperture of the food package. With this aspect of the invention, similar advantages and preferred features are present as in the previously discussed first aspect of the invention.

According to a third aspect of the present invention there is provided a method for manufacturing a one-way valve for mounting over an aperture formed on a food package for cooking, storing and/or heating of ready-to-eat food. The method comprises coating a center portion and each of two lateral edge portions on a top surface of a first membrane with a first adhesive. The center portion and the two lateral edge portions are non-overlapping, and the lateral edge portions extend from a first longitudinal edge to an opposite second longitudinal edge of the first membrane. The method further comprises applying a second adhesive on each of the two intermediate portions between each coated lateral edge portion and the coated center portion. The two intermediate portions extend from a first longitudinal edge to an opposite second longitudinal edge of the overlapping surface area, and wherein a bond strength of the second adhesive is stronger than that of the first adhesive. Furthermore, the method comprises arranging a second membrane on the top surface of the first membrane, and applying a force on an upper surface of the second membrane and/or on a bottom surface of the first membrane in order to distribute the second adhesive between the between the coated lateral edge portions and the coated center portion.

Further embodiments of the invention are defined in the dependent claims. It should be emphasized that the term "comprises/comprising" when used in this specification is taken to specify the presence of stated features, integers, steps, or components. It does not preclude the presence or addition of one or more other features, integers, steps, components, or groups thereof.

An advantage of some embodiments is that the first adhesive acts as sides of a mould for the second adhesive such that the second adhesive is evenly spread along the desired portions of the overlapping surface area, thereby reducing the risk of any unwanted channels for air passage.

An advantage of some embodiments is that the risk of creating holes in any of the first and second membrane during the manufacturing process is reduced.

An advantage of some embodiments is that the need to constantly regulate the machines during the manufacturing process is reduced, which results in reduced waste and higher yield.

An advantage of some embodiments is that quality control processes can be reduced during manufacturing, which results in reduced manufacturing costs.

These and other features and advantages of the present invention will in the following be further clarified with reference to the embodiments described hereinafter.

BRIEF DESCRIPTION OF THE FIGURES

Further objects, features and advantages of embodiments of the invention will appear from the following detailed description, reference being made to the accompanying drawings, in which.

DETAILED DESCRIPTION OF VARIOUS EMBODIMENTS

Figure 1A:
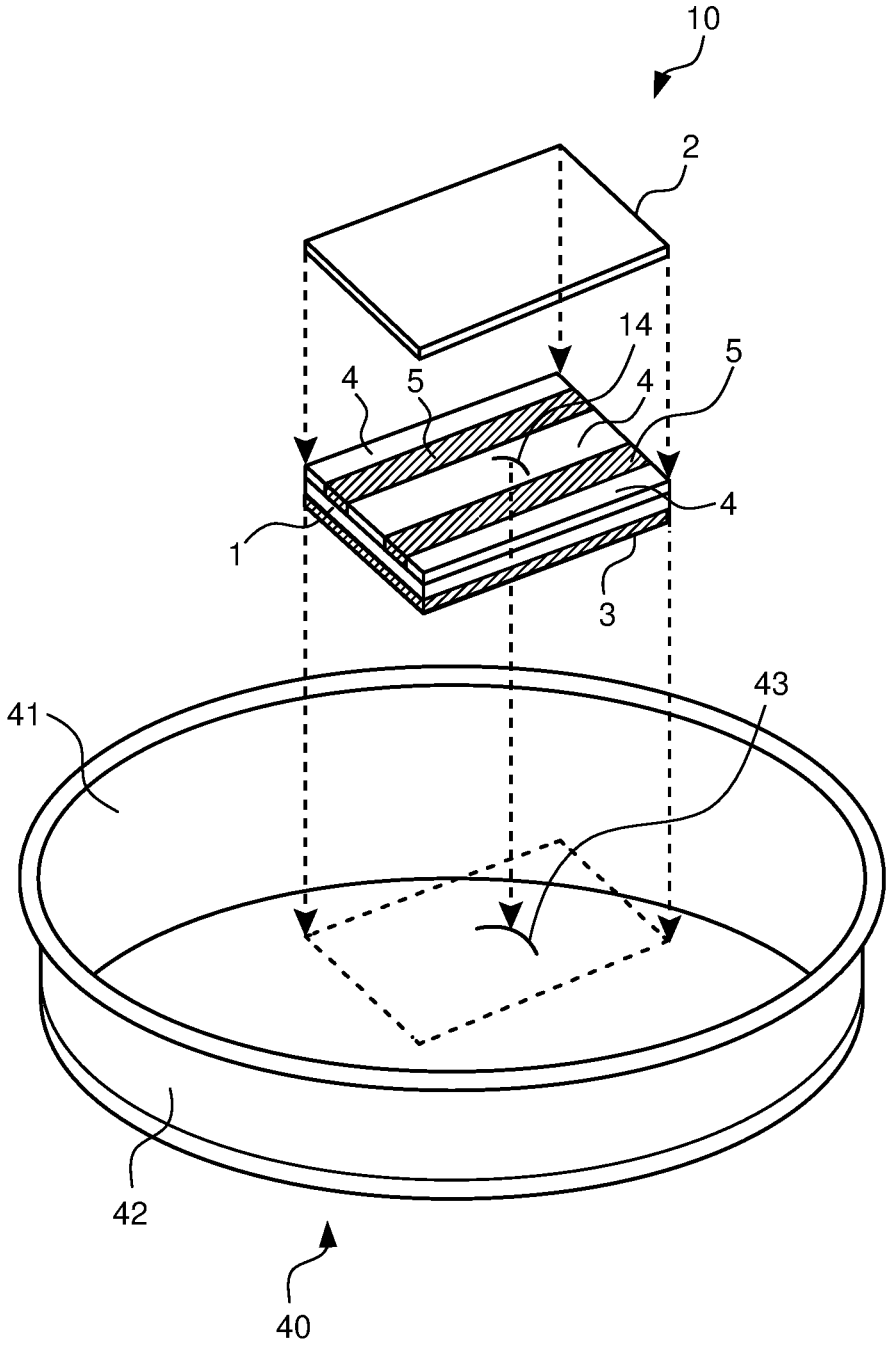
FIG. 1*a* is a schematic perspective and partially exploded view of a one-way valve mounted over an aperture formed on a food package for cooking, storing and/or heating of ready-to-eat food in accordance with an embodiment of the present invention.

In the following detailed description, embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention.

In the following description of exemplary embodiments, the same reference numerals denote the same or similar components. It will be understood that, although the term first, second, etc. may be used herein to describe various elements, these elements should not be limited by these terms. These terms are only used to distinguish one element from another.

The following description will use terms such as "top", "bottom", "upper", "lower", "lateral", "longitudinal", "edge", etc. These terms generally refer to the views and orientations as shown in the drawings. The terms are used for the reader's convenience only and shall not be construed as limiting.

FIG. 1 is a schematic perspective view illustration of a one-way valve 10 mounted over an aperture 43 that is formed in a food package 10 for cooking, storing, and/or heating ready-to-eat food, in accordance with an embodiment of the present invention. The food package is here in the form of a rigid container 42, preferably made of a suitable plastic material, covered with a plastic film 41 for sealing the inside of the food package from the ambient atmosphere. The plastic film 41 is fixed along the outer circumference of the rigid container 42 (e.g. a rigid plastic container) of the food package 40. As illustrated, the aperture 41 may for example be in the form of a cut 43 in the plastic film 41. The plastic film 41 may for example be a plastic film comprising Polyamide (PA).

Figure 3:
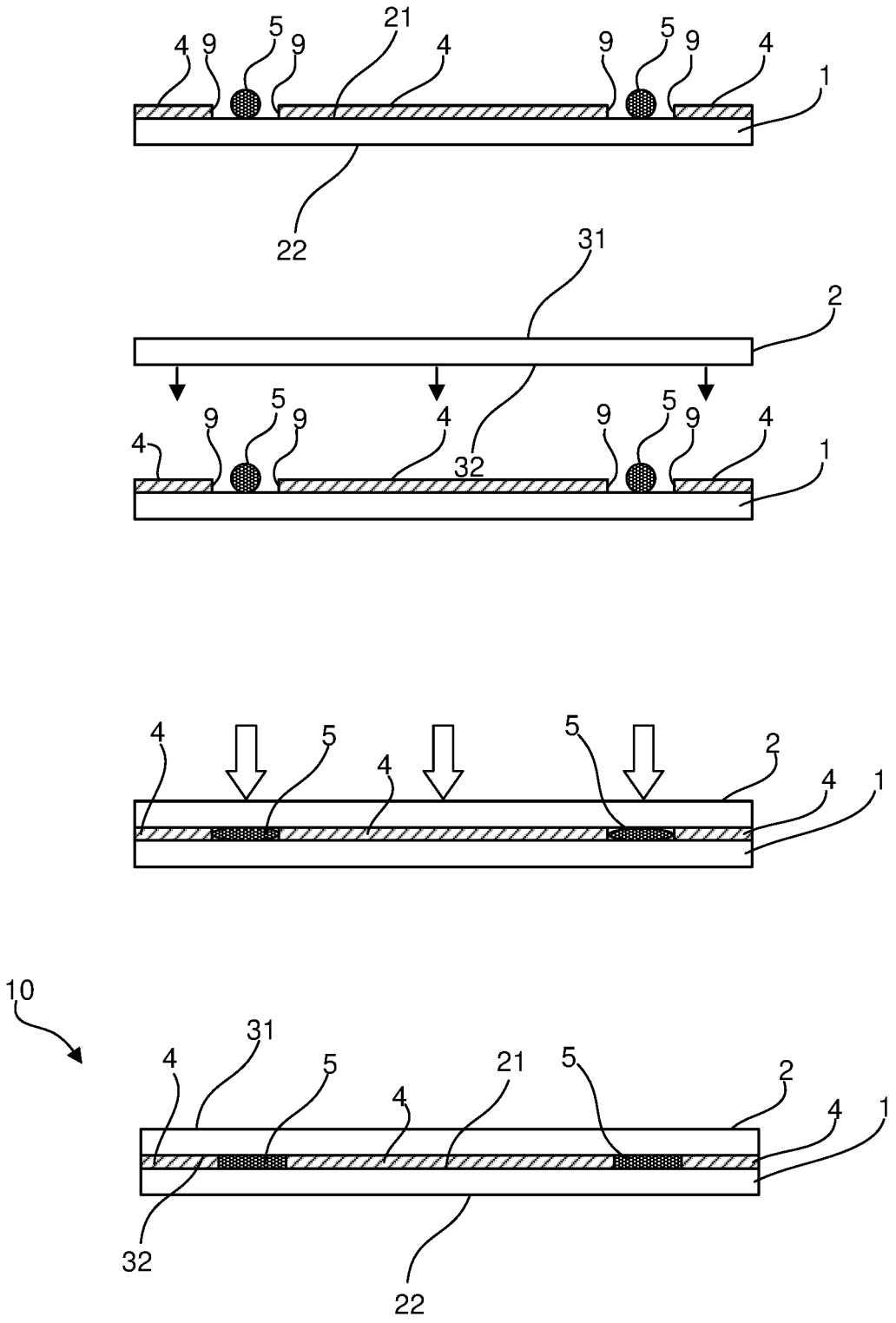
FIG. 3 is a series of cross-sectional views indicative of a method for manufacturing a one-way valve for mounting over an aperture formed on a food package for cooking, storing and/or heating of ready-to-eat food in accordance with an embodiment of the present invention.

The one-way valve 10 comprises a first membrane 1 (may also be referred to as a first membrane, first layer or first label) having a top surface (see e.g. ref 21 in FIG. 3) and a bottom surface (see e.g. ref 22 in FIG. 3). The bottom surface is adapted to be fixed to the food package 40 (or more specifically to the plastic film 41 of the food package). The bottom surface may for example be coated with a suitable adhesive 3 for adhering or sticking the first membrane 1 to the plastic film 41 of the food package. The adhesive 3 arranged on the bottom surface of the first membrane may for example be a hot-melt adhesive, or any other suitable type of thermoplastic adhesive. The one-way valve 10 further comprises a second membrane 2 (may also be referred to as a second membrane, second layer or second label) having an upper surface (see e.g. ref 31 in FIG. 3) and a lower surface (see e.g. ref. 32 in FIG. 3). Since the one-way valve 10 is symmetrical the upper surface of the second membrane 2 may be adapted to be fixed to the food package 40 (or more specifically to the plastic film 41 of the food package), instead of the bottom surface of the first membrane 1. Similarly, the upper surface of the second membrane may be coated with a suitable adhesive for adhering or sticking the second membrane 2 to the plastic film 41 of the food package. The first and second membrane may for example be made from thermoelastic polyvinylchloride (PVC), polyurethane (PUR), or similar materials.

The lower surface of the second membrane 2 is adhered/fixed/attached to the top surface of the first membrane 1 by means of a first adhesive 4 and a second adhesive 5, where the bond strength of the second adhesive 5 is higher than that of the first adhesive 4. In accordance with some embodiments, the bond strength of the second adhesive 5 is higher than that of the first adhesive 4 in the temperature range of 2° C.-250° C., such as for example 2° C.-150° C., or 2° C.-125° C. This should however not be construed as that the relation between the bond strength of the two adhesives 4, 5 is limited to this range, since the bond strength of the second adhesive may also be higher/stronger outside of the above specified temperature ranges.

In some embodiments, the bond strength of the second adhesive 5 is at least 2N/25 mm for a 180° peel test at room temperature (i.e. at a temperature in the range of 19° C.-21° C.). During a 180 degree peel test, a constant 180° angle is maintained while the two glued components (i.e. the two membranes 1, 2) are peeled apart from each other. For the purpose of the test, it is also assumed that the entire interfacing surfaces of the two membranes 1, 2 are coated with the second adhesive 5. Suitably the width of the membranes is also chosen to be 25 mm.

Accordingly, the average load needed to separate the two components, over the length of the specimen is documented and stated as [N]/[width in mm]. Stated differently, the result of the 180 degree peel test is the 'force per unit width' required to continue peeling the joint after initiation and is expressed typically as N/mm.

The second adhesive 5 may for example be a two-component glue, a UV activated glue (UV curing adhesive), or a solvent that is configured to "melt" the two membranes and thereafter evaporate leaving the two membranes fixed together at the portions where the solvent was applied. Moreover, in some embodiments, the second adhesive is a hot-melt adhesive (hot glue).

Further, the first adhesive 4 is arranged on a center portion (see e.g. ref. 11 in FIGS. 2*a* and 2*b*) and each of two lateral edge portions (see e.g. ref. 12*a* and ref. 12*b* in FIGS. 2*a* and 2*b*) of an overlapping surface area of the first membrane 1 and the second membrane 2. Moreover, the center portion and the two lateral edge portions are non-overlapping. The lateral edge portions extend from a first longitudinal edge (see e.g. ref. 16*a* in FIGS. 2*a* and 2*b*) to an opposite second longitudinal edge (see e.g. ref. 16*b* in FIGS. 2*a* and 2*b*) of the overlapping surface area. The second adhesive 5 is arranged on each of two intermediate portions (see e.g. ref. 13*a* and ref. 13*b* in FIGS. 2*a* and 2*b*), between each of the lateral edge portions and the center portions. The two intermediate portions also extend from the first longitudinal edge to the opposite second longitudinal edge of the overlapping surface area. Further examples and details concerning the center portion, lateral edge portions, and the intermediate portions are provided in reference to FIGS. 2*a* and 2*b* below.

Moreover, the first membrane 1 has an opening 14 that may be in the form of a cut. The opening 14 is provided in a portion of the first membrane 1 that coincides with the center portion of the overlapping surface area of the two membranes 1, 2. The opening 14 provides for a canal to be formed between the first membrane and the second membrane when the one-way valve 10 is mounted over the aperture 44 of the food package 40 and a gas pressure inside the food package exceeds a threshold value. The formation of the canal (i.e. the opening of the one-way valve 10) may also be temperature dependent. The canal extends from the opening 14 to at least one of the first and second longitudinal edges via the center portion of the overlapping surface area.

Figure 1B:
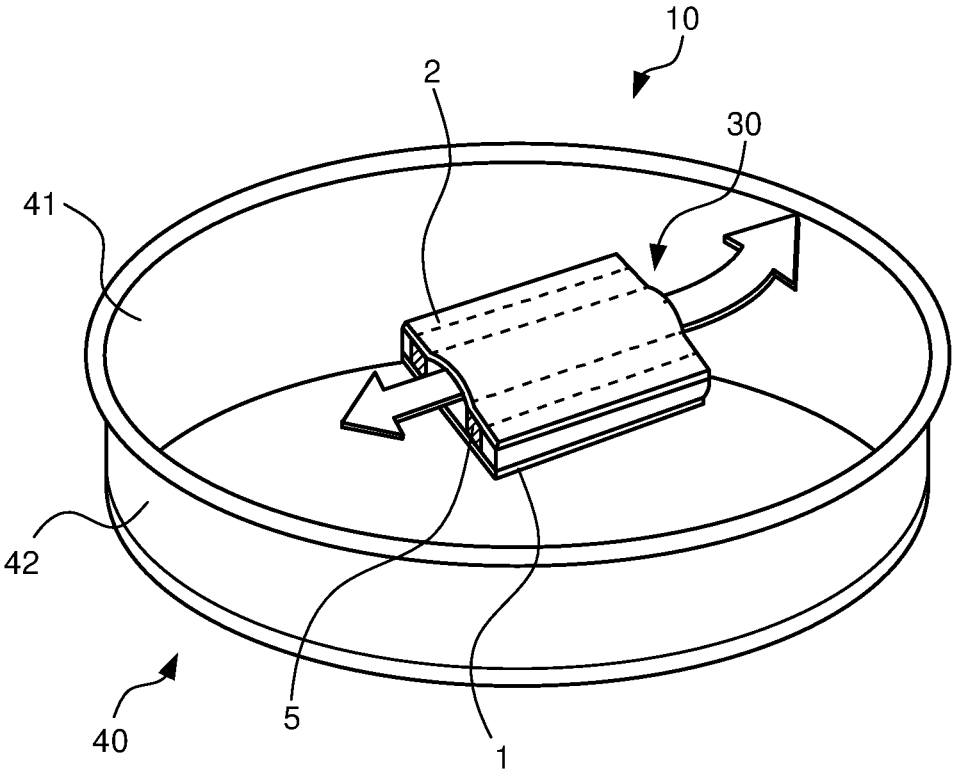
FIG. 1*b* is a schematic perspective view of the one-way valve of FIG. 1*a* with an open canal for releasing steam and gases from the food package.

FIG. 1*b* illustrates the one-way valve 10 of FIG. 1*a* with an open canal 30 for releasing steam and gases from the food package 40 when the gas pressure inside the food package exceeds the threshold value. In more detail, in FIG. 1*b* the canal extends from the opening 14 to both of the longitudinal edges via the center portion. However, as readily understood by the skilled artisan, and as will be elaborated upon and exemplified further, the canal 30 may extend from the opening 14 to only one of the longitudinal edges e.g. depending on specific realizations of the one-way valve 10 (see e.g. FIG. 2*b*) or due to specific scenarios. In reference to the latter, in some situations the canal 30 may reach one of the longitudinal edges faster than the other one (e.g. due to local temperature variations of the one-way valve 10) and thereby only open one "exit path".

Accordingly, the first adhesive 4 arranged on the center portion has a function to release the first membrane 1 from the second membrane 2 when heat and pressure from the cooking process reaches a certain threshold. The second adhesive 5 on the other hand has a function to maintain a bond between the first membrane and the second membrane when the canal opens such that the one-way valve can close once the heat and pressure from the cooking process drops below the threshold. The re-closing of the valve may accordingly prevent or at least reduce the risk of contaminants entering the food package.

Moreover, the first adhesive 4 effective forms a mould for the second adhesive 5 during the manufacturing process, whereby the risk of having any "unglued" areas in the overlapping surface area is reduced. Moreover, as compared with other manufacturing methods (e.g. ultrasonically welding the two membranes at the two intermediate portions) the risk of either causing inadvertent holes in any of the membranes 1, 2 or creating spaces/gaps between the adhered center portion and the intermediate portions is reduced.

In more detail, for ultrasonic welding alternatives, in order to reduce the risk of creating a space/gap between the coated area of the overlapping surface area and the ultrasonic pattern in the un-glued area (intermediate portions), the design of the ultrasonic bond is made to create an overlap into the glued area. This overlap is set to some suitable value (e.g. a couple of mm) and shall cover variations in the position of the un-glue area on the top layer and the position of the top layer versus the position of the ultrasonic pattern anvil. The process of welding the two membranes together is by hammering a pattern into the "top" membrane. This hammering of the top membrane is done to create a strong bond between the layers. However, holes may occur in the area where ultrasonic welding and the coated surface overlaps as this area is thicker and the process applies higher force. This area is also the most sensitive for holes as it is the closest point to where the valve opens and the hole may be worsened by stretch of film and air/steam passing though.

Figure 2A:
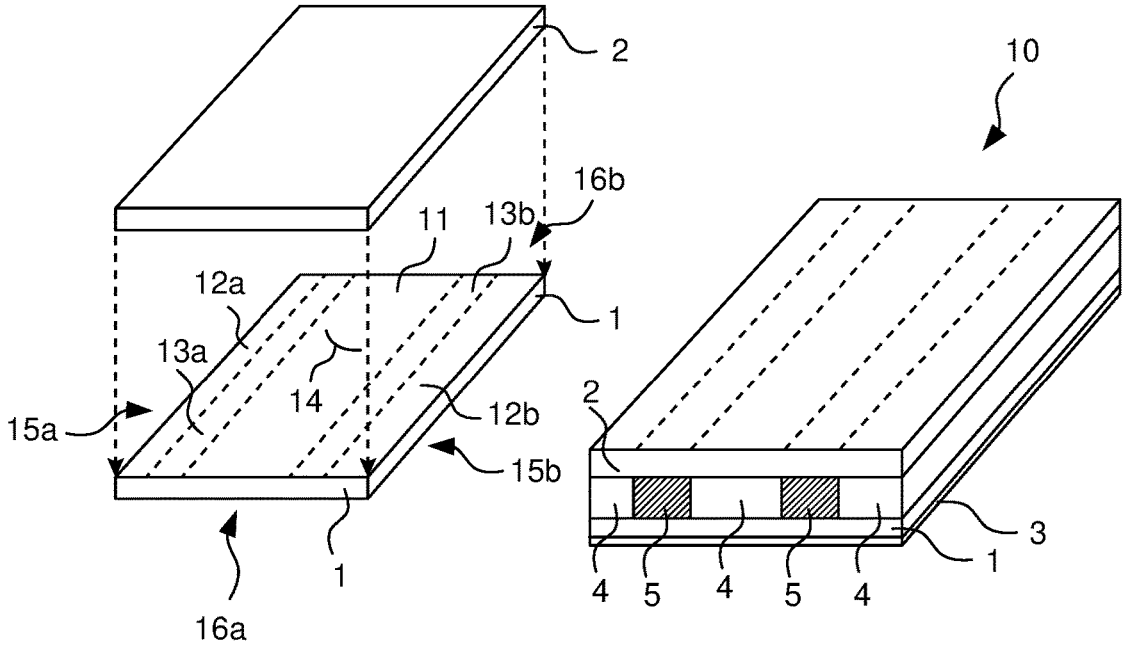
FIG. 2*a* is a schematic perspective view of a one-way valve for mounting over an aperture formed on a food package for cooking, storing and/or heating of ready-to-eat food in accordance with an embodiment of the present invention.

FIG. 2*a* is a schematic exploded view of the two membranes 1, 2 of a one-way valve 10 (left part of the figure) and a schematic perspective view of a one-way valve 10 (right part of the figure) arranged to be mounted over an aperture formed on a food package in accordance with an embodiment of the present invention. More specifically, the two illustrations schematically indicate the extension and form of the center portion 11, the two lateral edge portions 12*a*, 12*b* and the two intermediate portions 13*a*, 13*b* of the overlapping surface area.

The term "overlapping surface area" may in the present context be understood as the interface between the first membrane 1 and the second membrane 2 when the membranes are arranged on top of each other. The first membrane 1 and the second membrane 2 may be of substantially equal size and fixed to each other with the edges/corners aligned such that the overlapping surface area corresponds to the area of the lower surface of the second membrane 2 (or analogously, the area of the top surface of the first membrane 3). However, in some embodiments (not shown), the first membrane 1 and the second membrane 2 are of different sizes (i.e. the area of the top surface of the first membrane 1 is different than the area of the lower surface of the second membrane 2). In such cases, and where the two membranes 1, 2 are fixed to each other such that the footprint of the smaller membrane is completely enclosed by the larger membrane, the "overlapping surface area" will correspond to the footprint of the smaller membrane.

Moving on, in the embodiment depicted in FIG. 2*a*, the center portion 11 and the two lateral edge portions 12*a*, 12*b* form three parallel lanes in the overlapping surface area of the first membrane 1 and the second membrane 2. Moreover, the two intermediate portions 13*a*, 13*b* form two parallel lanes having lateral borders defined by the center portion 11 and the two lateral edge portions 12*a*, 12*b*.

Accordingly, the lower surface of the second membrane 2 is adhered to the top surface of the first membrane 1 by means of a first adhesive 4 arranged on the center portion 11 and each of the two lateral edge portions 12*a*, 12*b*. The center portion and the two lateral edge portions are non-overlapping and extend from a first longitudinal edge 16*a* to an opposite second longitudinal edge 16*b* of the overlapping surface area. Furthermore, the lower surface of the second membrane 2 is adhered to the top surface of the first membrane 1 by means of a second (stronger) adhesive 5 arranged on each of the two intermediate portions 13*a*, 13*b* between each lateral edge portion 12*a*, 12*b* and the center portion 11. The two intermediate portions extend from the first longitudinal edge 16*a* to the opposite second longitudinal edge 16*b*.

Figure 2B:
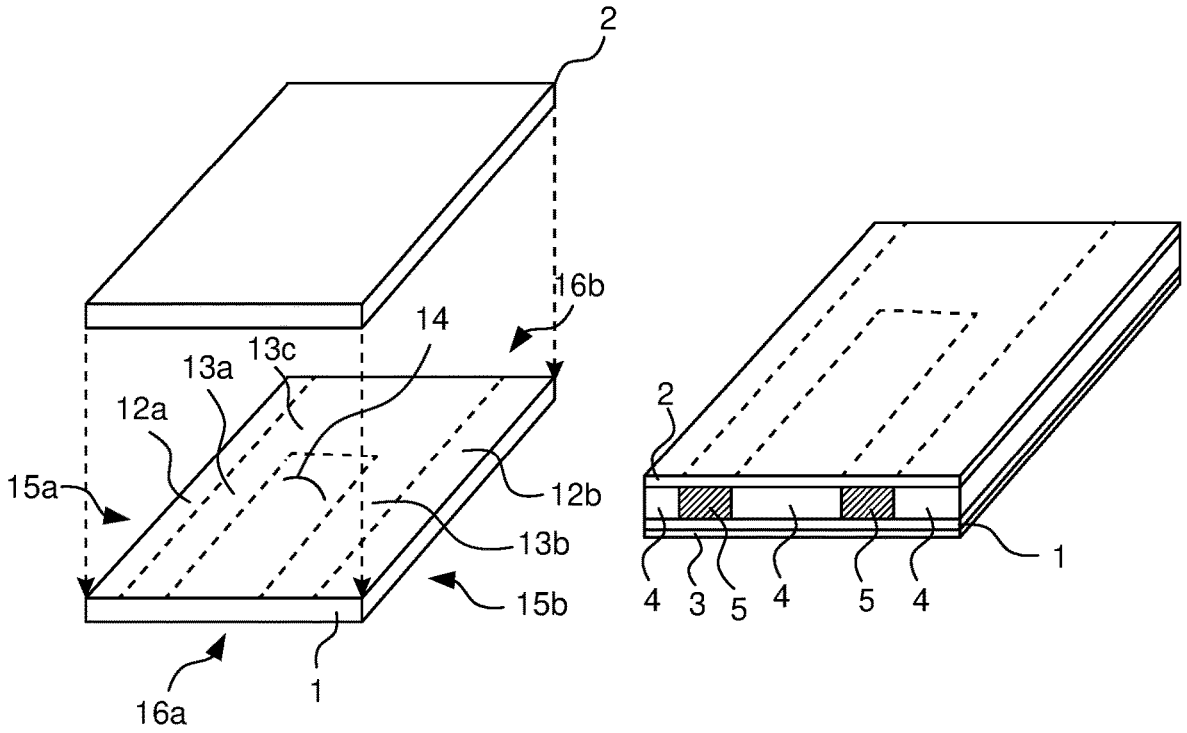
FIG. 2*b* is a schematic perspective view of a one-way valve for mounting over an aperture formed on a food package for cooking, storing and/or heating of ready-to-eat food in accordance with an embodiment of the present invention.

FIG. 2*b* is a schematic exploded view of the two membranes 1, 2 of a one-way valve 10 and a schematic perspective view of a one-way valve 10 for mounting over an aperture formed on a food package in accordance with an embodiment of the present invention. In this example embodiment, the configuration of the center portion 11 and the intermediate portions 13*a*, 13*b* are different as compared to the example embodiment depicted in FIG. 2*a*. In more detail, the intermediate portions 13*a*, 13*b* further comprise an additional intermediate portion 13*c* such that the intermediate portions 13*a*, 13*b*, 13*c* (and consequently the extension of the second adhesive 5) form a U-shape, where the center portion 11 is arranged between the bifurcated parts of the intermediate portions 13*a*, 13*b*, 13*c*. The center portion 11 accordingly extends from the first longitudinal edge 16*a* to the additional intermediate portion 13*c*.

FIG. 3 illustrates a series of cross-sectional views indicative of a method for manufacturing a one-way valve 10 in accordance with some embodiments. Here, a center portion and each of two lateral edge portions of a top surface 21 of a first membrane 1 are coated with a first adhesive 4. The center portion and the two lateral edge portions are non-overlapping. Further, a second adhesive 5 is applied on each of the two intermediate portions between each coated lateral edge portion and the coated center portion. As before, the bond strength of the second adhesive is stronger than that of the first adhesive.

Further, a second membrane 2 is arranged on the top surface of the first membrane 1, thereby sandwiching the first adhesive 4 and the second adhesive 5 between the two membranes 1, 2. Moreover, the first adhesive 4 forms three parallel lanes, where the three parallel lanes form longitudinal sides 9 of a mould for the second adhesive 5.

Next, a force is applied on an upper surface 31 of the second membrane in order to distribute the second adhesive between the between the coated lateral edge portions and the coated center portion. Additionally or alternatively, the force may be applied on a bottom surface 22 of the first membrane 1. As illustrated in FIG. 3, the second adhesive 5 is pressed outwardly towards the longitudinal sides 9 of the first adhesive 4, effectively and evenly distributing the second adhesive 5 in the intermediate portions. Any excess second adhesive may effectively be pushed out through the longitudinal edges of the overlapping surface area.

Further, the bottom surface 22 of the first membrane 1 or the upper surface 31 of the second membrane 2 may be coated with an adhesive for fixing the one-way valve 10 to the food package.

Figure 4:
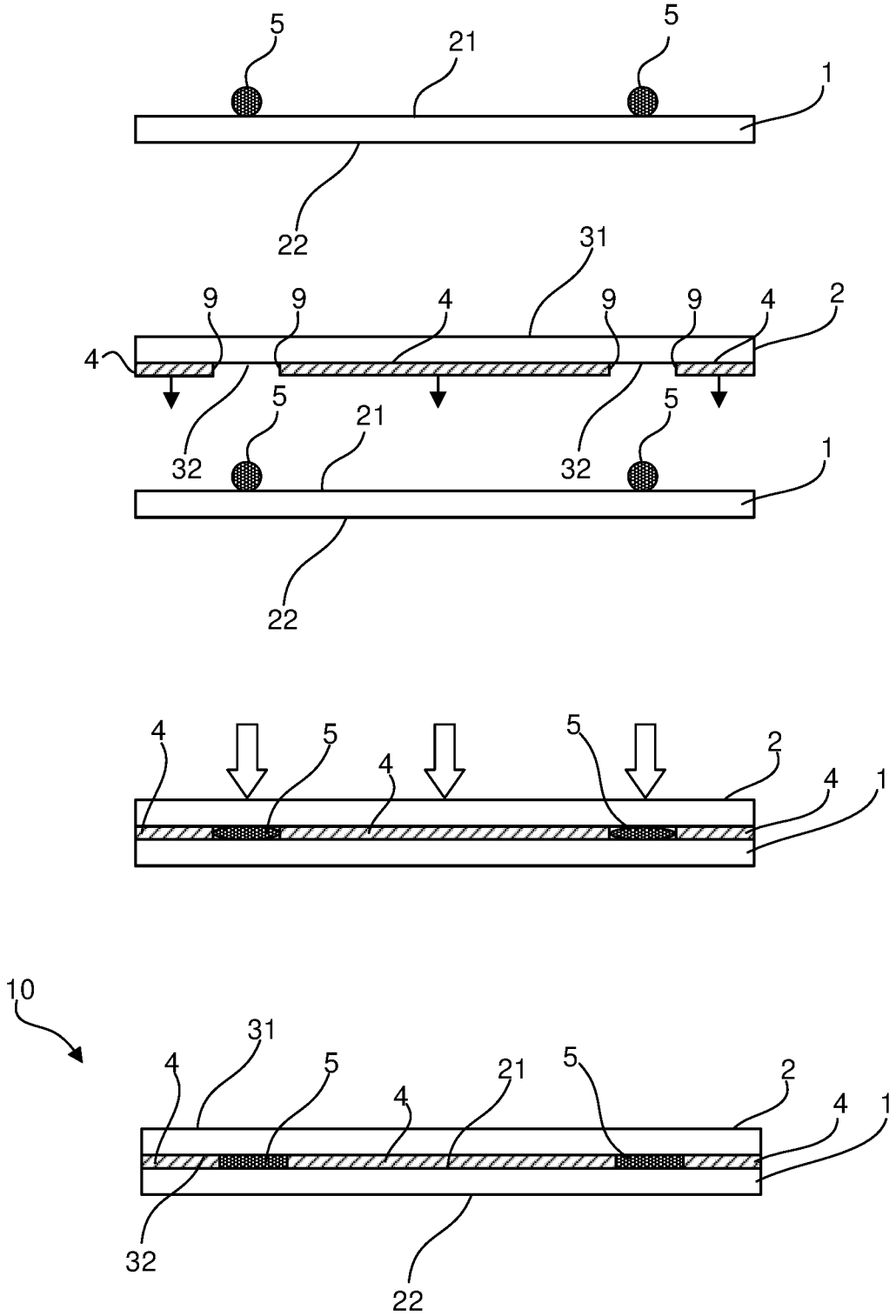
FIG. 4 is a series of cross-sectional views indicative of a method for manufacturing a one-way valve for mounting over an aperture formed on a food package for cooking, storing and/or heating of ready-to-eat food in accordance with an embodiment of the present invention.

FIG. 4 illustrates a series of cross-sectional views indicative of a method for manufacturing a one-way valve 10 in accordance with some embodiments. Here, the second adhesive 5 is applied on the top surface 21 of the first membrane along two longitudinal lines. More specifically, the second adhesive 5 is arranged on the aforementioned "two intermediate portions". Further, the first adhesive 4 is provided on a lower surface 32 of the second membrane 2. More specifically, the center portion and each of two lateral edge portions of the lower surface 32 of the second membrane 2 are coated with the first adhesive 4. Thus, the first adhesive 4 may for example be a hot-melt adhesive (hot glue), or any other suitable type of thermoplastic adhesive.

Further, the second membrane 2 is arranged on top of the first membrane 1 such that the second adhesive 5 contacts the lower surface 32 of the second membrane 2 between the coated center portion and lateral edge portions. Next, a force is applied on an upper surface 31 of the second membrane in order to distribute the second adhesive between the between the coated lateral edge portions and the coated center portion. Additionally or alternatively, the force may be applied on a bottom surface 22 of the first membrane 1. As before, the second adhesive 5 is pressed outwardly towards the longitudinal sides 9 of the first adhesive 4, effectively and evenly distributing the second adhesive 5 in the intermediate portions. Any excess second adhesive may effectively be pushed out through the longitudinal edges of the overlapping surface area. Further, the bottom surface 22 of the first membrane 1 may be coated with an adhesive for fixing the one-way valve 10 to the food package. However, as readily understood by the skilled reader, due to symmetry, the upper surface 31 of the second membrane may be coated with an adhesive for fixing the one-way valve 10 to the food package. The second membrane 2 will then act as the "bottom label", wherefore the second membrane 2 may further be provided with an opening (see e.g. ref 14 in FIGS. 2*a*-2*b*) in the center portion of the second membrane 2 instead of the first membrane 1.

Figure 5:
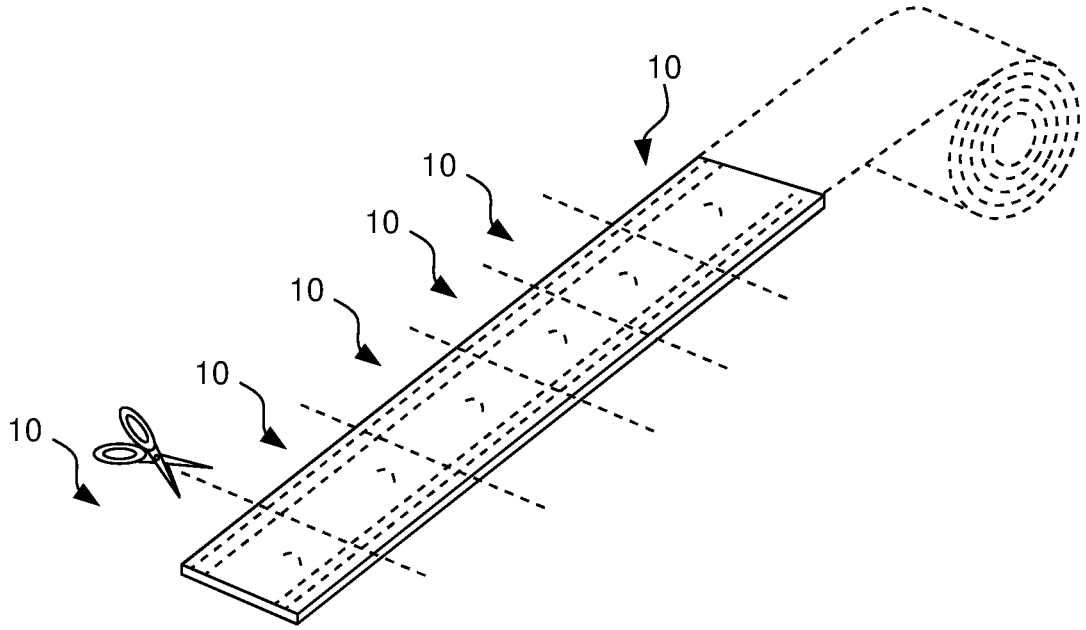
FIG. 5 is a perspective view of a plurality of one-way valves for mounting over an aperture formed on a food package for cooking, storing and/or heating of ready-to-eat food in accordance with an embodiment of the present invention.

FIG. 5 is a perspective view of a plurality of one-way valves 10 provided on continuous roll, where each individual one-way valve may be cut from the roll. Accordingly, the one way valve may be manufactured in accordance with the above-described process, where the adhesives are provided on rolls of material (forming the first and second membranes respectively) and subsequently fed into a device that fixes the two rolls together consequently forming a single roll of one-way valves 10. However, as readily understood by the skilled reader, the one-way valves 10 may be manufactured as discrete elements.

It should be noted that the word "comprising" does not exclude the presence of other elements or steps than those listed and the words "a" or "an" preceding an element do not exclude the presence of a plurality of such elements. It should further be noted that any reference signs do not limit the scope of the claims, that the invention may be at least in part implemented by means of both hardware and software, and that several "means" or "units" may be represented by the same item of hardware.

The above mentioned and described embodiments are only given as examples and should not be limiting to the present invention. Other solutions, uses, objectives, and functions within the scope of the invention as claimed in the below described patent embodiments should be apparent for the person skilled in the art.

The invention claimed is:

1. A one-way valve (10) for mounting over an aperture formed on a food package for cooking, storing and/or heating of ready-to-eat food, the one-way valve comprising:

a first membrane (1) comprising a top surface (21) and a bottom surface (22), wherein the bottom surface is adapted to be fixed to the food package;

a second membrane (2) comprising an upper surface (31) and a lower surface (32);

wherein the lower surface of the second membrane is adhered to the top surface of the first membrane by means of:

a first adhesive (4) arranged on a center portion (11) and each of two lateral edge portions (12*a*, 12*b*) of an overlapping surface area of the first membrane and second membrane, wherein the center portion and the two lateral edge portions are non-overlapping, and wherein the lateral edge portions (12*a*, 12*b*) extend from a first longitudinal edge (16*a*) to an opposite second longitudinal edge (16*b*) of the overlapping surface area;

a second adhesive (5) arranged on each of two intermediate portions (13*a*, 13*b*) between each lateral edge portion (12*a*, 12*b*) and the center portion (11), the two intermediate portions extending from the first longitudinal edge (16*a*) to the opposite second longitudinal edge (16*b*) of the overlapping surface area, and wherein a bond strength of the second adhesive (5) is stronger than that of the first adhesive (4);

wherein the first membrane (1) comprises an opening (14) such that a canal is formed between the first membrane and the second membrane when the one-way valve (10) is mounted over the aperture of the food package and a gas pressure inside the food package exceeds a threshold value, wherein the canal extends from the opening to at least one of the first longitudinal edge and the second longitudinal edge via the center portion (11) of the overlapping surface area.

2. The one-way valve (10) according to claim 1, wherein the bottom surface (22) is coated with an adhesive (3) for fixing the first membrane to the food package.

3. The one-way valve (10) according to claim 2, wherein the bottom surface (22) is coated with the first adhesive.

4. The one-way valve (10) according to claim 1, wherein the center portion (11) and the two lateral edge portions (12*a*, 12*b*) form three parallel lanes in the overlapping surface area of the first membrane and the second membrane, and wherein the two intermediate portions (13*a*, 13*b*) form two parallel lanes having lateral borders defined by the center portion and the two lateral edge portions.

5. The one-way valve (10) according to claim 1, wherein the first adhesive (4) forms lateral boundaries (9) for the second adhesive in the overlapping surface area of the first membrane and the second membrane.

6. The one-way valve (10) according to claim 1, wherein the second adhesive (5) is a two-component adhesive.

7. The one-way valve (10) according to claim 1, wherein the second adhesive (5) is a UV curing adhesive.

8. The one-way valve (10) according to claim 1, wherein the bond strength of the second adhesive is at least 2N/25 mm for a 180 degree peel test on the first membrane and the second membrane at a temperature of 20° C.

9. The one-way valve (10) according to claim 1, wherein the one-way valve has a rectangular shape such that the long sides (15*a*, 15*b*) define the lateral edges of the one-way valve (10) and the short sides (16*a*, 16*b*) define the longitudinal edges of the one-way valve (10).

10. A food package for cooking, storing and/or heating of ready-to-eat food, the food package comprising:

a food container and a plastic film for sealing the food container from ambient air, the plastic film including an aperture; and a one-way valve (10) according to claim 1 covering said aperture such that the opening (14) of the one-way valve overlaps the aperture of the food package.

11. The food package according to claim 9, wherein the aperture in the plastic film is a cut.

12. A method for manufacturing a one-way valve (10) for mounting over an aperture formed on a food package for cooking, storing and/or heating of ready-to-eat food, the method comprising:

coating a center portion and each of two lateral edge portions on a top surface of a first membrane with a first adhesive, wherein the center portion and the two lateral edge portions are non-overlapping, and wherein the lateral edge portions extend from a first longitudinal edge to an opposite second longitudinal edge of the first membrane;

applying a second adhesive on each of the two intermediate portions between each coated lateral edge portion and the coated center portion, wherein the two intermediate portions extend from a first longitudinal edge to an opposite second longitudinal edge of the overlapping surface area, and wherein a bond strength of the second adhesive is stronger than that of the first adhesive;

arranging a second membrane on the top surface of the first membrane;

applying a force on an upper surface of the second membrane and/or on a bottom surface of the first membrane in order to distribute the second adhesive between the between the coated lateral edge portions and the coated center portion.

13. The method according to claim 12, wherein the first adhesive forms three parallel lanes on the top surface of the first membrane, the three parallel lanes forming longitudinal sides (9) of a mould for the second adhesive.

14. The method according to claim 12, further comprising:

coating the bottom surface of the first membrane with an adhesive for fixing the one-way valve to the food package, the first membrane comprising an opening on a center portion thereof.

* * * * *